US005993234A

United States Patent [19]

Yodogawa

[11] Patent Number: 5,993,234

[45] Date of Patent: Nov. 30, 1999

[54] SOCKET FOR PRINTED BOARDS

[75] Inventor: Akihiro Yodogawa, Fujisawa, Japan

[73] Assignee: Berg Technology, Inc., Reno, Nev.

[21] Appl. No.: 08/930,789

[22] PCT Filed: Apr. 10, 1996

[86] PCT No.: PCT/US96/04837

§ 371 Date: Oct. 7, 1997

§ 102(e) Date: Oct. 7, 1997

[87] PCT Pub. No.: WO96/32764

PCT Pub. Date: Oct. 17, 1996

[30] Foreign Application Priority Data

Apr. 14, 1995 [JP] Japan ..... 7-089754

[51] Int. Cl.[6] ..... H01R 23/68

[52] U.S. Cl. ..... 439/326

[58] Field of Search ..... 439/326, 64, 79, 439/541.5

[56] References Cited

U.S. PATENT DOCUMENTS 5,116,237 5/1992 Loewen ..... 439/326

5,174,780 12/1992 Yang Lee ..... 439/326

*Primary Examiner*—Gary F. Paumen

*Attorney, Agent, or Firm*—Daniel J. Long; M. Richard Page

[57] ABSTRACT

A socket (10) for printed boards is provided which enables a plurality of printed boards to be mounted readily and positively and can be manufactured at low costs in a very simple way. The socket comprises a housing (14) having insertion holes (32, 34) opened on one side to allow printed boards to be received, a greater number of spring contacts (12) of an electroconductive material formed in contact arrays in the insertion holes and urging the printed boards in the same direction with their edges inserted relative to the respective contact arrays into the insertion holes and a plurality of latch arms (18) extending from near-end areas of the respective insertion holes and, when the respective printed boards are rotated in a direction to urge the contacts, latch the side edges of the printed boards in place.

8 Claims, 7 Drawing Sheets

SOCKET FOR PRINTED BOARDS

BACKGROUND OF THE INVENTION

1. Field of the Invention

The present invention relates to a socket for a printed circuit board which serves as a connector for allowing the edge of the printed circuit board to be directly inserted therein as a plug section and, in particular, a socket for allowing a plurality of printed circuit boards to be mounted therein.

2. Brief Description of Prior Developments

In recent years, there has been a growing demand for high-density integration packages and various low insertion force type connectors have been developed.

Generally, such a low insertion force type connector serves as a socket mounted on a substrate of an electronic device, that is, a so-called mother board, and comprises a housing of an insulating material. The housing has an insertion slot for allowing the edge of a printed circuit board called "a daughter board to be received therein. The housing has an array of spring contacts therein with the contact sections of the spring contacts projected in the insertion hole for the printed board. These contacts are formed as two contact arrays along the longitudinal direction of the insertion hole and a gap is created between these contact arrays to receive the edge of the printed circuit board therein. The contact arrays are arranged, in an offset state, in the depth direction of the insertion slot, that is, along the insertion direction of the printed board. When, therefore, the printed circuit board is inserted, it is contacted at one surface side of its edge with the contact array in a position near the forward end of the edge of the printed board and at the other surface side with the associated contact array in a position remote from the position above.

When the edge of the printed board is inserted between the contact arrays and the printed board is rotated in a direction to cause these contact arrays to be displaced away from each other, the contact sections of the spring contacts are displaced by a spring force trying to bring the contact sections of the spring contacts back to their original position, the respective contacts are placed in positive contact with associated conductors arranged at the edge of the printed board.

The printed board is held in a rotated position by a latch mechanism and positively fixed to the housing while maintaining a better contact state between the respective contacts and the printed board.

The conventional socket serving as such a low insertion force type connector has only one insertion hole and, if a plurality of printed boards are required, it is necessary to provide a corresponding number of sockets.

In the case where a plurality of printed boards are mounted on the housing, more space is required and it is, therefore, difficult to obtain such an electronic device as a compact and low cost unit.

SUMMARY OF THE INVENTION

It is accordingly the object of the present invention to provide a socket for printed boards which enables a plurality of printed boards to be attached and detached easily and positively.

A socket for printed boards in accordance with the present invention comprises a housing made of an insulating material and having a plurality of insertion holes opened on one side in a juxtaposed relation to allow edges of the printed boards to be received therein, a larger number of spring contacts made of an electroconductive material and formed in at least one contact array in, and along a longitudinal direction of, the respective insertion slot with their contact portions projected in the insertion hole and adapted to urge the respective printed boards in the same direction with the edges of the printed boards inserted into the insertion holes relative to the respective contact arrays, and a plurality of pairs of latch arms extending from near-end areas of the respective insertion slots and, when the respective printed circuit boards are rotated in a direction to bias the contacts, latching the side edges of the printed board, whereby the printed boards fitted in the respective insertion slots are held by the paired latch arms in a juxtaposed state.

Preferably, the socket further comprises a pair of support arms extending from the ends of the housing and on one side of the housing where the insertion slots are opened and a pair of latch guides attached to the support arms and, when the latch arms are moved between a position where the latch arms latch the side edges of the printed circuit board and a position where the latch arms unlatch the side edges of the printed board, guiding the latch arms adjacent to the support arms, in which the respective latch guide is comprised of one metal plate having a fitting section fitted at the support arm and a plurality of guide sections extending from the fitting section and guiding the respective latch arm.

Preferably, the spring contact has a fixing section fitted to the housing, a spring section extending from the fixing section and elastically supporting the contact and an electroconductive section extending from the fixing section to an outside of the housing, in which a flexible area is provided at a leg section between the electroconductive section and the fixing section to absorb a force involved.

Preferably, the housing has a larger number of contact grooves receiving the spring contacts in a mutually insulating state and the respective contact groove has a spring section receiving area elastically deformably holding the spring section of the spring contact and communicating with the corresponding insertion hole area retaining the fixing section of the contact firmly in place, a connection area leading the electroconductive section to an outside of the housing, and a contact insertion hole opened at one of said one side and other side of the housing.

Preferably, the housing has two outer walls extending in the longitudinal direction and two insertion slots extending at an intermediate section between the two outer walls and in a mutually parallel relation and, in this case, all the contact insertion holes can be opened on said other side of the housing. Preferably, the contact grooves provided at one side of the insertion slot to receive those contacts in the contact array have connection areas opened on said one side and the contact grooves provided at the other side of the insertion slot to receive those contacts in the associated contact array have connection areas opened on said other side of the housing.

Preferably, the housing has a fixing wall projected in the contact grooves provided at one side of the insertion slot to receive those contacts in the contact array and situated in the retaining area in the contact groove and the fixing section of the spring contact fitted in the contact groove has a post section and an arm section holding the fixing wall relative to the post section and said electroconductive section extends from the arm section.

According to the socket of the present invention, when the edge of the respective circuit printed board is inserted into the insertion slot of the housing, the contact portions of the respective contacts are brought into contact with the associated electroconductive sections arranged in the edge of the printed board. When the respective circuit printed board is rotated against an urging force of the spring contact in a direction to urge the contact portion and brought to a predetermined position, then the respective printed circuit board has its side edges latched by the paired latch arms. By doing so, the respective printed circuit boards are mounted in the socket in a mutually juxtaposed state.

When the respective printed circuit board is to be detached from the socket, the latch arms are moved in a sideward direction of the printed board so that the printed board is unlatched from the socket. By doing so, the printed circuit board is urged by the spring contacts back to the initial position. In this state, the printed board is pulled back from the insertion slot and hence out of the socket. Since the respective printed circuit boards are individually held by the corresponding paired latch arms, it is possible to mount the printed board in a given requisite insertion slot alone as required.

The socket further includes paired support arms provided on one side of the housing where the insertion slot is opened and extending from respective ends of the housing and paired latch guides fitted at the paired support arms and, when the latch arms are moved between a position where the side edges of the printed board are latched and a position where the side edges of the printed board are unlatched, guiding the latch arms adjacent the support arms. In the case where the respective latch guide is formed out of one metal sheet having a fitting section fitted at the support arm and a plurality of guide sections extending from the fitting section and guiding the latch arms, the latch guide allows the latch arms to be smoothly guided. It is, therefore, possible to latch and unlatch the printed board.

The spring contact has a fixing section fixed to the housing, a spring section extending from the fixing section and elastically supporting the contact portion of the contact, and an electroconductive section extending from the fixing section to outside of the housing. If, in this case, a flexible area is provided at a leg section between the electroconductive section and the fixing section to absorb a force involved, it absorbs an external force acting upon the spring contact or a force transmitted through an area of contact with the spring contact so that it is possible to prevent any adverse effect produced from these forces.

Further, a larger number of contact grooves are provided in the housing to hold associated spring contacts in a mutually insulated state and respective contact grooves have a spring section holding area elastically deformably holding the spring section and communicating with the corresponding insertion slot, a retaining area retaining the above-mentioned fixing section firmly in place, a connection section to lead the above mentioned electroconductive section to an outside of the housing, and a contact insertion slot opened at one of said one side and other side of the housing and, in this case, the spring contacts can be positively mounted at the housing without impairing their spring function.

In the case where the housing has two outer walls extending in the longitudinal direction and two insertion slots formed at an intermediate wall extending between the outer walls and in a mutually, substantially parallel relation, a distance between the two insertion slots can be made to correspond to the thickness of the printed board.

In the case where ail the above-mentioned contact insertion grooves are opened on the side opposite to that of the latch arms, the spring contacts can be mounted there without being hindered by the latch arms or support arms. In this case, those contact grooves holding contacts in a contact array at one side of the insertion slot have connection areas opened on said one side of the housing, while, on the other hand, those contact grooves holding contacts in a contact array at the other side of the insertion slot have connection areas opened on said other side of the housing, so that electroconductive sections of the mutually adjacent spring contacts are maintained at a required interval.

Further, the housing has a fixing wall projected into the contact groove holding the spring contact of the contact array at one side of the insertion slot and situated in the retaining area of the contact groove and the fixing section of the spring contact fitted in the contact groove has a post section and an arm section holding the fixing section relative to the post section so that, in the case where the electroconductive section extends from that arm section, the spring contact can be positively held in place even if the post section of the respective spring contact is short.

DESCRIPTION OF THE PREFERRED EMBODIMENTS

Figure 1:
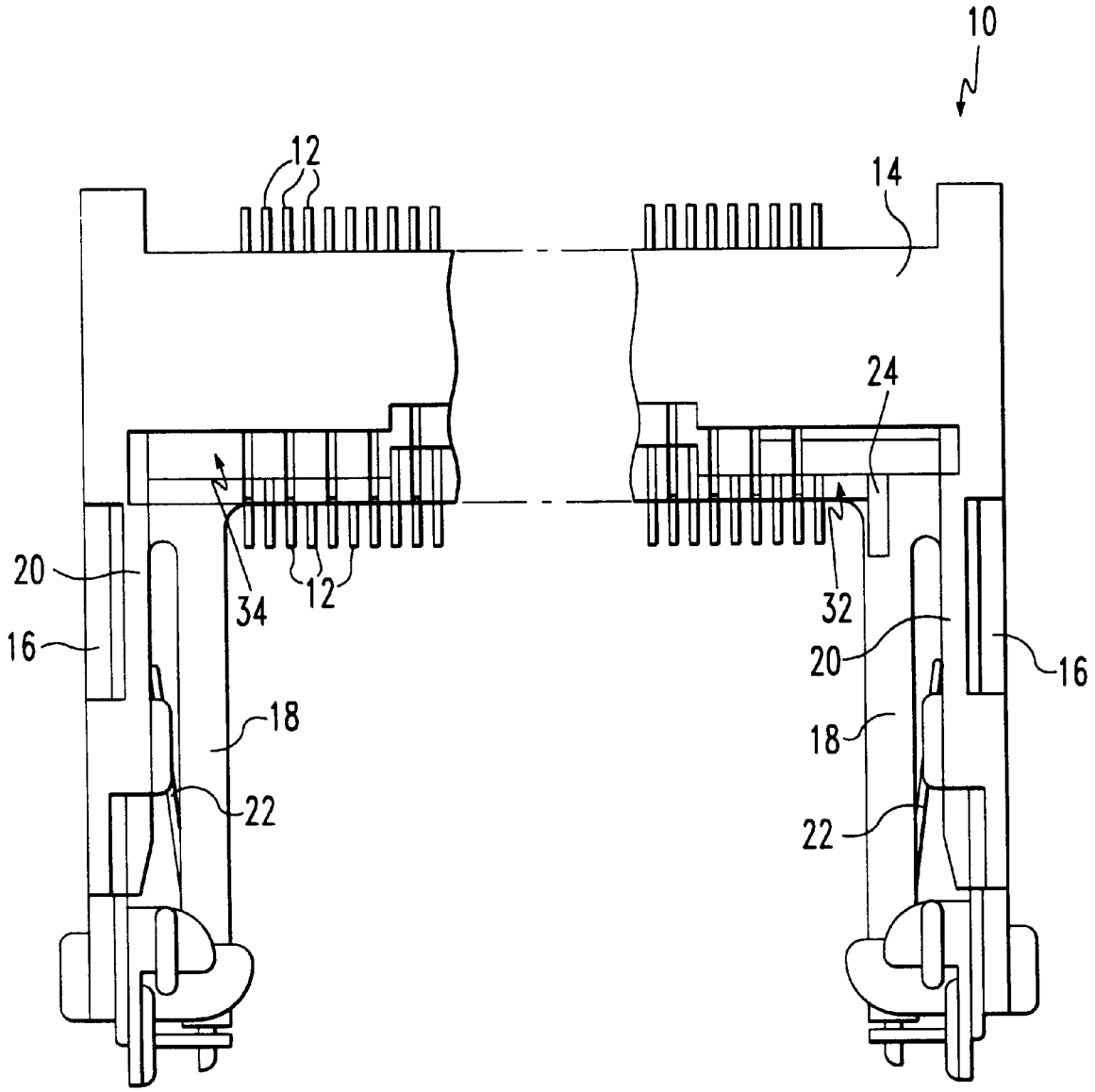
FIG. 1 is a plan view diagrammatically showing a socket for printed boards in accordance with an embodiment of the present invention.

FIGS. 1 to 7 show a socket 10, for printed boards, according to the present invention. As shown in FIG. 1, the socket 10 for the printed boards includes a housing 14 with a large number of spring contacts 12 arranged at predetermined intervals. A pair of support arms 16, 16, as well as latch arms 18, 18 and 20, 20 constituting two pairs of latch arms, extend one at each end of the housing 14. Latches 22, 22 as will be set out above are attached to the support arms 16, 16, The latch arms 18, 18 and latch arms 20, 20 are guided by the latch guides 22, 22. The housing 14, support arms 16, 16, and latch arms 18, 18, 20, 20 are formed as an integral member and made of an insulating material, such as an LCP (liquid crystal polymer). Reference numeral 24 shows a polarity key which prevents the insertion error of printed boards 6, 8 (see FIGS. 3 and 5A, 5B).

Figure 2:
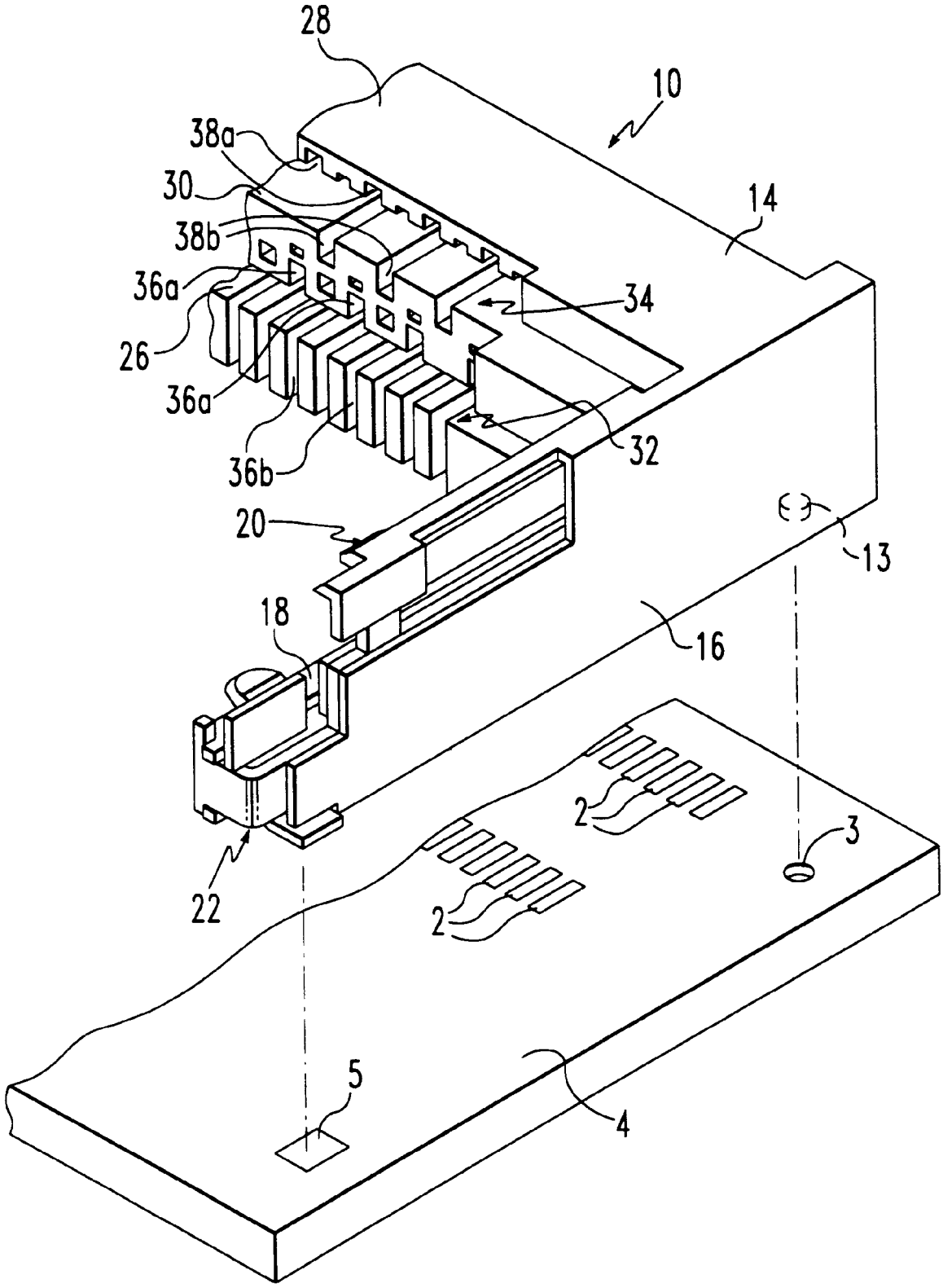
FIG. 2 is a perspective view diagrammatically showing a portion of a housing structure with spring contacts omitted.

As shown in FIG. 2, the housing 14 has lower and upper wall sections 26 and 28 providing a pair of outer wall sections on the upper and lower sides and an intermediate wall section 30 situated between the lower wall section 26 and the upper wall section 28. The intermediate wall section 30 extends further from the upper wall section 28 and the lower wall section 26 extends still further from the intermediate wall section 30. Insertion slots 32 and 34 are provided one between the lower wall section 26 and the intermediate wall section 30 and one between the intermediate wall section 30 and the upper wall section 28 side to receive the edges of printed boards 6, 8 (FIGS. 4 and 5A, 5B) comprising a daughter board each. The insertion slots 32, 34 extend across both the mid portions of the housing 14 and are situated substantially parallel to each other. The spacing between the insertion slots 32, 34 is made somewhat greater than the thickness of the printed boards 6, 8 and formed such that, upon being inserted, these boards are placed in a not mutually contacting state.

The paired latch arms 18, 18 are coupled to the lower wall section 26 at those areas near the longitudinal ends of the insertion slot 32 situated at the lower side and their upper surfaces situated on the insertion slot 32 side are placed in substantially the same plane as the upper surface of the lower wall section 26. Further, the latch arms 20, 20 are coupled to the upper wall section 28 at those areas near the longitudinal ends of the insertion slot 34 situated on the upper side. These latch arms 18, 20 are made smaller in cross-section than the support arms 16 to provide a flexible structure. On the other hand, the support arm 16 has a relatively rigid structure.

As shown in FIG. 2, the socket 10, for printed boards, according to the present invention is of such a so-called side entry type that the board is inserted in parallel to the surface of a mother board 4 of an electronic apparatus, that is, inserted with the insertion slots 32, 34 opened in a lateral direction. In this case, an alignment projection 13 is provided on the housing 14 and fitted in an alignment hole 3 in the mother board 4 so that the support arms 16, 16 are horizontally placed on the surface of the mother board. From the type of a contact array, the socket is made a so-called DIMM (dual in-line memory module) type.

Contact grooves 38*a* are opened at a predetermined equidistant interval at the insertion slot 34 side of the upper wall section to receive the corresponding spring contacts 12 in a mutually insulated state. Even in the intermediate wall section 30 extending further than the upper wall section 26, contact grooves 38*b* are opened at a predetermined equidistant interval on the insertion slot 34 side. These contact grooves 38*a*, 38*b* are alternately provided along the longitudinal direction of the insertion slot 34.

Similarly, at the insertion slot 32 side of the intermediate wall section and lower wall section, contact grooves 36*a*, 36*b* are opened such that they are alternately arranged at a predetermined interval along the longitudinal direction of the insertion slot 32. The spring contacts 12 are fitted in the contact grooves 36*a*, 36*b* in a mutually insulated state.

Figure 3:
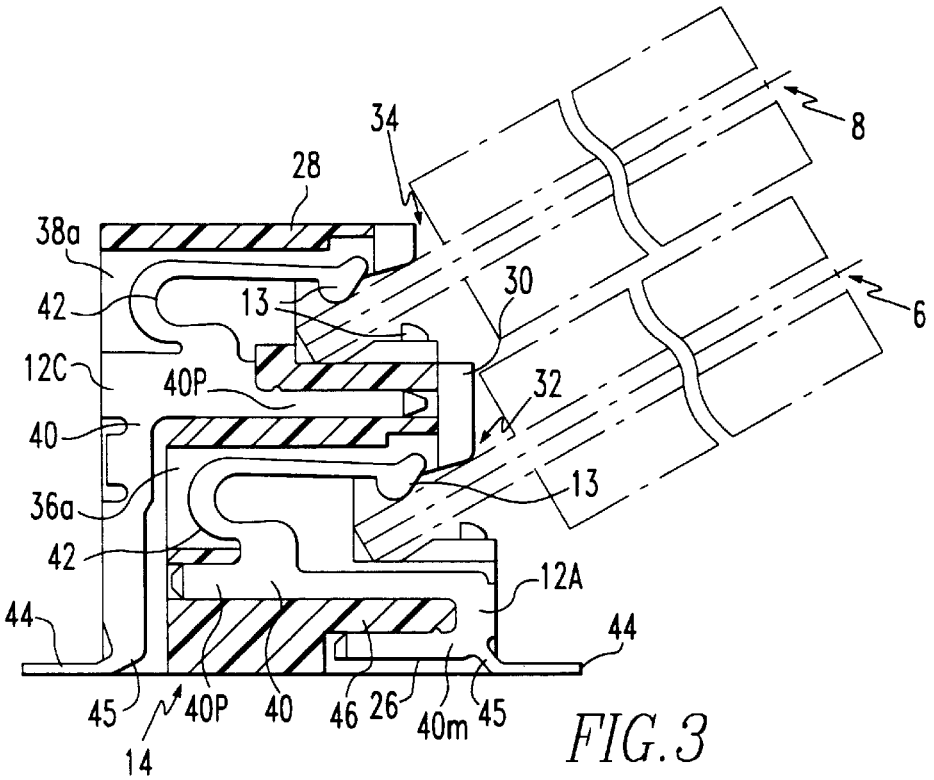
FIG. 3 is a cross-sectional view showing an arrangement of the spring contacts in the housing.
Figure 4:
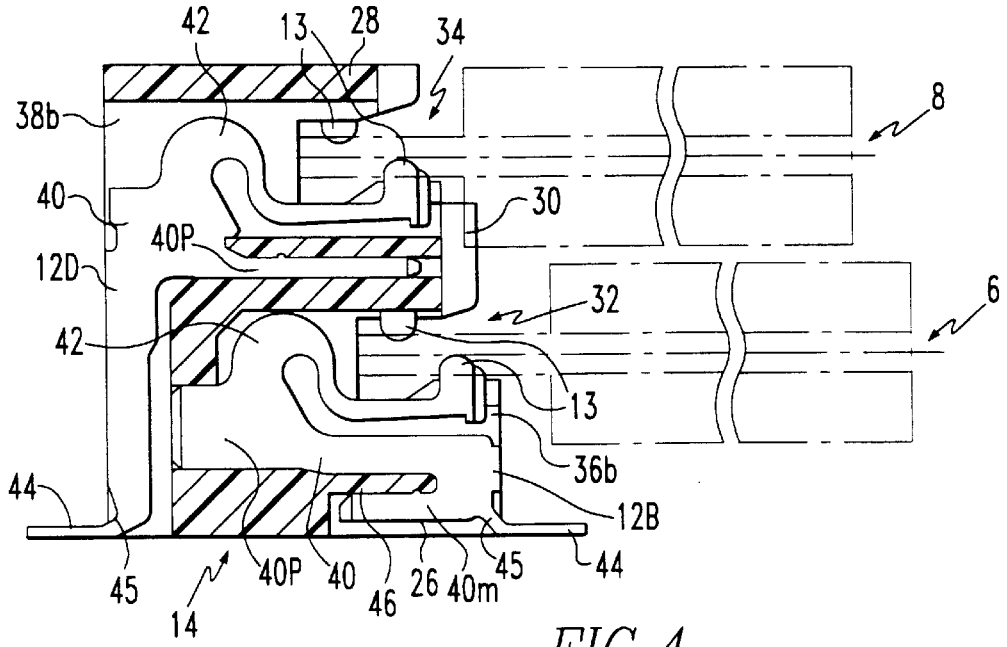
FIG. 4 is a cross-sectional view showing a state in which printed boards are mounted in the housing.

As shown in FIGS. 3 and 4, the spring contacts 12 of the present embodiment comprise four kinds of spring contacts 12A, 12B, 12C and 12D of different shapes punched out of an electroconductive material such as a copper alloy sheet material.

The spring contacts 12A, each, have a contact portion 13 extending from the contact groove 36*a* of the intermediate wall section 30 into the insertion slot 32 and all provide a contact array along the longitudinal direction of the insertion slot 32. The spring contacts 12B, each, have a contact portion 13 extending from the contact groove 36*b* of the lower wall section 26 into the insertion slot 32 and all provide a contact array along the longitudinal direction of the insertion slot 32. The spring contacts 12C, each, have a contact portion 13 extending from the contact groove 38*a* of the upper wall section 28 into the insertion slot 34 and all provide a contact array along the longitudinal direction of the insertion slot 34. The spring contacts 12D, each, have a contact portion 13 extending from the contact groove 38*b* of the intermediate wall section 30 into the insertion slot 34 and all provide a contact array along the longitudinal direction.

The contact portions 13 of the respective spring contacts 12A and 12B provide an array of contacts arranged in the insertion slot 32 and situated in a depth direction in an offset relation so that they urge the printed board 6 in a counter-clockwise direction through the edge of the printed board 6. Similarly, the contact portions 13 of the spring contacts 12C and 12D provide an array of contacts arranged in the insertion slot 34 and situated in a depth direction in an offset relation so that they urge the printed board 8 in a counter-clockwise direction through the edge of the printed board 8. For this reason it is desirable that a holding section be provided on the intermediate wall section 30 and upper wall section 28 at least at those areas facing the insertion slots 32 and 34. Against urging forces of the respective spring contacts 12A, 12B, 12C and 12D, such holding sections can support the respective printed boards 6 and 8 in a state as shown in FIG. 3. Further, when the printed boards 6 and 8 are unlatched from the latch arms 18 and 20, the holding sections can prevent the printed boards 6 and 8 from being abruptly rotated and dropped by an impact force at that time from the insertion slots 32 and 34.

In the embodiment as shown in FIGS. 3 and 4, the spring contacts 12A, 12B, 12C and 12D, each, have a fixing section 40 fixed to the housing 14 and a spring section 42 extending from the fixing section 40 and elastically supporting the contact portion 13 of the spring contact. A post section 40*p* is provided on the fixing section 40 of the spring contact and closely fitted into a contact groove as will be set out below. It is to be noted that a proper projection may be provided on the fixing section 40 of the spring contact so that it can be bitten into the material of which the housing 14 is made. In this case it is possible to prevent unauthorized dropping of the spring contact 12 from the housing.

Further, an electroconductive section 44 is provided as a projection on the fixing section 40 extending out of the housing 14. The electroconductive section 44 of the fixing section 40 is soldered to a corresponding electroconductive section 2 (FIG. 2) formed on the surface of the mother board 4. A flexible area 45 is provided at a leg section between the electroconductive section 44 and the fixing section 40 of the spring contact to allow a force involved to be absorbed. In the present embodiment, the flexible area 45 has a small diameter inclined portion formed near the electroconductive section 44 so that it provides a deformable structure.

For this reason, even if the mother board 4 for example is warped thereby producing misalignment relative to the lower wall section 26 of the housing 14, the flexible area 45 can accommodate or alleviate such a misalignment and maintain a better contact state between the contact portion 13 and the printed board. Further, when the printed board is mounted on the housing, it is possible to prevent a force acting, by the spring section 42, upon the electroconductive section soldered to the electroconductive section 2 of the mother board 4.

On the other hand, the contact grooves 36*a*, 36*b*, 38*a* and 38*b* for accommodating the spring contacts 12A, 12B, 12C and 12D have spring section holding areas accommodating elastically deformable spring sections 42 and opened into, or communicating with, the corresponding insertion slots 32 and 34 and holding areas firmly holding the fixing sections 40 of the spring contacts in place and having inner holes closely receiving the post sections 40P in place. Further, the contact grooves 36*a,* 36*b,* 38*a* and 38*b* have connection areas to lead the electroconductive areas 44 to an outside of the housing and contact insertion hole opened outside the housing 14.

In the present embodiment, the contact insertion hole and connection area of the contact grooves 36*a,* 36*b* are opened on the right side of FIGS. 3 and 4 to allow the spring contacts 12A and 12B to be mounted from the insertion slot 32 side. On the other hand, the contact insertion hole and connection area of the contact grooves 38*a* and 38*b* are opened on the left side of FIGS. 3 and 4 and the spring contacts 12C and 12D can be mounted from a side opposite to the insertion hole 34. Further, as will be appreciated from the above, in the case where the spring contacts 12 are mounted from both the sides of the housing 14, it can be done so for a very brief period of time even if a larger number of spring contacts 12 have to be mounted.

Further, a fixing wall 46 extends out in the holding area of the contact grooves 36*a* and 36*b*. The fixing wall 46 is held between the post section 40P formed on the spring contacts 12A and 12B and an arm section 40M extending in parallel to the post section 40P. Even in the case where the post section 40P or the inner hole closely holding the post section 40P in place is short in length, the respective contacts 12A and 12B can be positively held in the contact grooves 36*a* and 36*b*.

The contact portions 13 of the spring contacts 12A and 12B provide two contact rows in the insertion slot 32 along the longitudinal direction and these contact rows are arranged in an offset state along the insertion direction of the printed board 6. Similarly, the contact portions 13 of the spring contacts 12C and 12D provide two contact arrays in the insertion hole 34 along the longitudinal direction and these contact rows are arranged in an offset state along the insertion direction of the printed board 8. As shown in FIG. 3, the edge of the printed boards 6 and 8 are inserted into the insertion holes 32 and 34 and, when the printed boards 6 and 8 are rotated in a clockwise direction, the contact portions 13 are pushed by the edge of the printed boards and spring sections 42 of the spring contacts try to bring the contact portions back to an initial position. The respective contact portions 13 of the spring contacts are pressed by these spring forces into contact with the corresponding electroconductive sections to ensure positive contact therebetween. Further, by the contact rows arranged in such offset relation a counter-clockwise moment acts upon the printed boards 6 and 8.

Figures 5A, 5B:
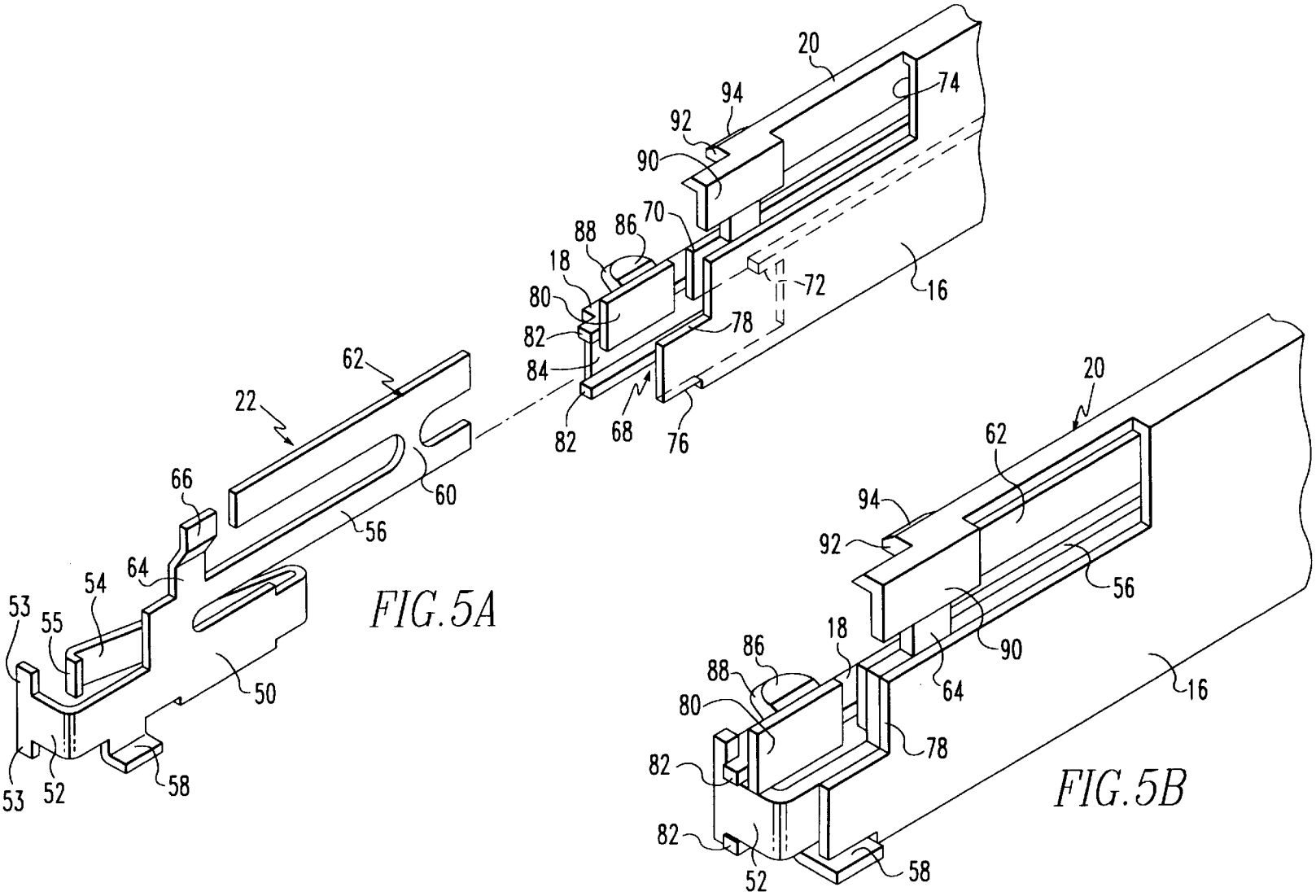
FIGS. 5A and 5B are perspective views, partly cut away, diagrammatically showing a structure of a latch mechanism in an unassembled and assembled condition, respectively.

FIGS. 5A, 5B show a latch mechanism for holding the printed circuit boards 6 and 8, which receive such a moment as set out above, at their side edges as viewed across their width direction. Such latch mechanisms for holding the side edges of the printed circuit boards are the same in their construction and only one of them will be explained below.

The latch mechanism of the present embodiment comprises a support arm 16 extending from the housing 14, a first latch arm 18, a second latch arm 20, and a latch guide 22 fitted relative to the support arm 16 to allow it to be guided by the latch arms 18 and 20. The support arm 16 and latch arms 18 and 20 are made of the same material as that of the housing 14.

As shown in FIGS. 5A, 5B the latch guide 22 is formed of a sheet material, such as a copper alloy. The latch guide 22 of the present embodiment has a fitting section 50 fitted at the forward end of the support arm 16, a guide section 52 bent substantially perpendicular from one end of the fitting section 50 and a spring section 54 bent back in a substantially reverse direction from the other end of the fitting section 50. The fitting section 50 has an L-shaped latching section 56 extending from its upper edge and a fixing leg 58 extending from its lower edge and adapted to be joined, by soldering for example, to a fixing section 5 (FIG. 2) formed at the surface of the mother board 4. Further the guide section 52 has a rectangular sheet-like configuration with a guide edge provided at its upper and lower sides and has projections 53, 53 extending from its forward end side. The spring section 54 of the latch guide 22 is placed in a gap between the latch arm 18 and the support arm 16 and has a curved portion 55. When the latch arm 18 is retracted, the spring section 54 has its curved portion 55 abutted against it.

Further, the latch guide 22 has a sheet-like guide arm 62 coupled through a connection section 60 to the upper edge of the latching section 56 and an auxiliary arm 64 extending from the upper edge of the latching section 56. A forward end portion 66 of the auxiliary arm 64 extends on a side opposite to the spring section 54 and is formed to have a flat configuration substantially parallel to the guide arm 62.

As shown in FIG. 5, the support arm 16 has, at its forward end section, a receiving recess 68 provided on the latch arm 18 side to receive the fitting section 50 of the latch guide, a slit 70 provided adjacent and above the receiving recess 68 to receive the latching section 56 of the latch guide and an opening 74 through which the guide arm 62 is inserted. Between the receiving recess 56 and the slit 70 a projecting section 72 is projected toward the forward end of the support arm 16 and, when the latch guide is fitted into the support arm 16, the fixing section 72 is grasped between the fitting section 50 and the latching section 56. The guide arm 62 extends via the opening 74 along the latch guide 20.

A cutout 76 is provided at a lower edge portion on the forward end portion of the support arm 16 to allow a fixing leg 58 of the latch guide 22 to pass therethrough and a cutout 78 is provided at an upper edge portion at the forward end side of the support arm 16 so as to prevent an interference with a lug 80 of the latch arm 18. The fixing leg 58 extends outwardly via the cutout 76.

The latch arm 18 has a pair of projections 82, 82 at its forward end and has a recess 84 provided on its side facing the support arm 16 so as to receive a curved portion 55 provided on the spring section 54 of the latch guide 22. An engaging projection 86 for latching the printed board 6 (see FIGS. 3 and 4) extends upwardly from the upper surface of the latch arm 18. An internally inclined cam 88 is provided on the upper side of the engaging section 88 and a lug 80 is provided on the support arm 16 side. By operating the lug 80, the latch arm 18 can be displaced in a curved way between a position (a position as shown in FIG. 1) in which the side edges of the printed board are latched by the latching sections 86 and a position (a position as shown in FIG. 7) in which the printed board is unlatched.

The latch arms 20 for latching the side edges of the printed circuit board 8 (FIGS. 3 and 4) are situated at an upper sides of the latch arms 18 and somewhat externally. The latch arm 20 has a lug 90 extending toward the support arm 16 and an engaging projection 92 extending on a side opposite to the lug 90 and latching the side edge of the printed board 8. A cam section 94 is provided on the upper side of the engaging projection 92 and the unlatched position of the latch arm 20 is as shown in FIG. 6.

In the case where the latch guide 22 is latched at the support arm 16, the latch section 56 is aligned with the slit 70 and inserted in a gap between the support arm 16 and the latch arm 18. The spring section 54 and curved portion of the latch guide are guided in the recess 55 of the latch arm 18 and the fitting section 50 is placed in the receiving recess 68 of the support arm. In this state, the latching section 56 and fitting section 50 hold the fixing section 72 firmly in place and the fitting section 50 is abutted against the side surface of the receiving recess 68. The guide arm 62 is projected via the opening 74 out of the support arm 16 and extends along the latch arm 20. Further, the forward end 66 of the auxiliary arm 64 is abutted against the lug 90 on the engaging projection 92 side of the latch arm 20.

Figure 6:
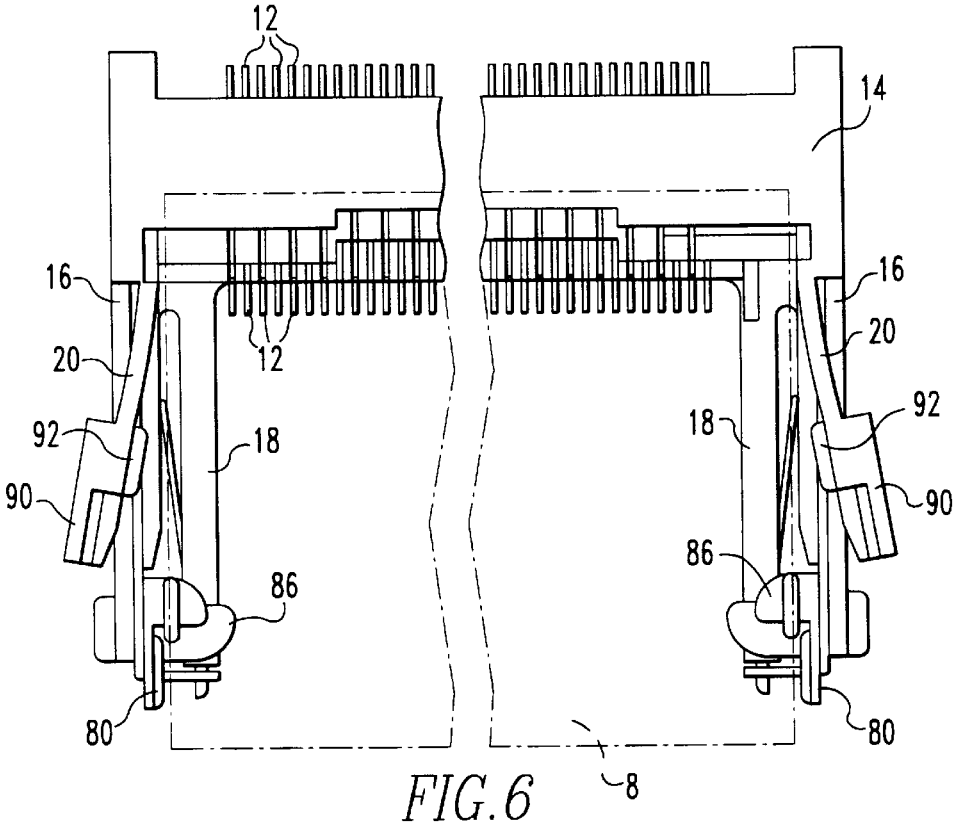
FIG. 6 is an explanatory view showing an operation of one pair of latch arms.
Figure 7:
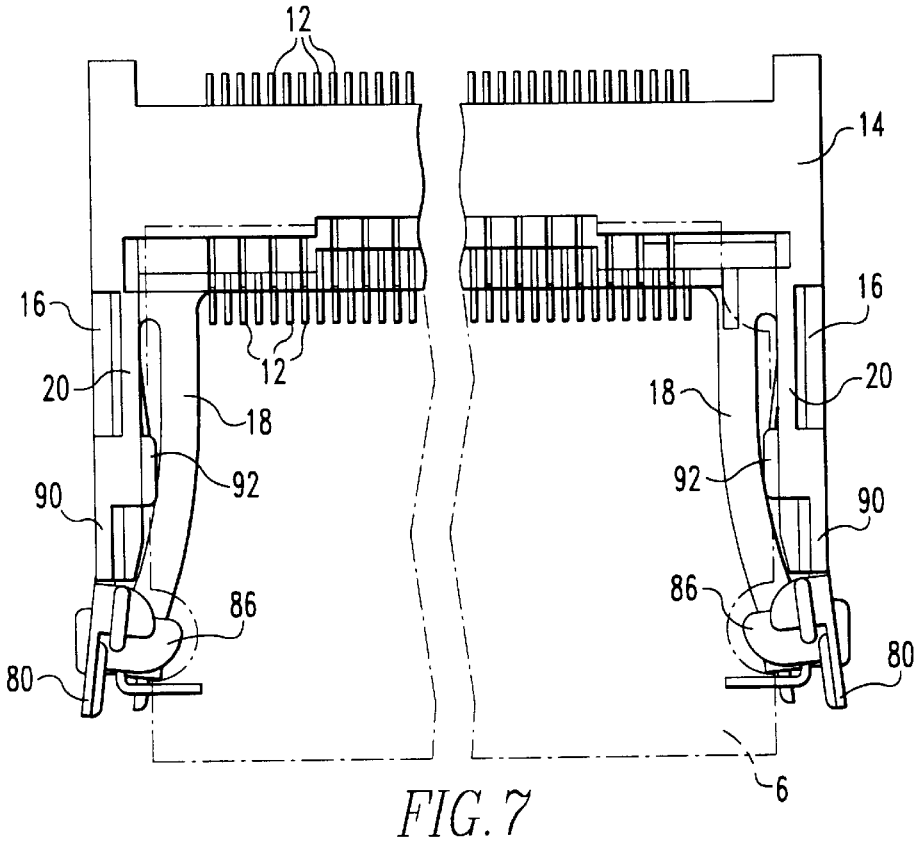
FIG. 7 is an explanatory view showing an operation of the other pair of latch arms.

FIGS. 6 and 7 show the operations of the latching mechanism so arranged. Although these Figures are separately shown so as to show the respective operations of the latch arms 18 and 20, it will be readily evident that the respective latch arms 18 and 20 are operated simultaneously.

As shown in FIG. 6, when the printed board 8 (FIG. 3) is inserted into the insertion slot 34 of the housing 14 and rotated into abutting engagement with the engaging projection 92 of the latch arm 92, then the cam surface 94 (FIGS. 5A, 5B) on the engaging projection 92 urges the latch arms 20 outwardly. At this time, the guide arms 62 of the latch guides 22 are, together with the latch arms 20, deformed, while preventing twisting of the latch arm 20, and so guided as to allow the latch guide 20 to be displaced in an arcuate way.

When, with the printed board 8 further rotated, the printed board 8 is moved clear of the engaging projection 92, the latch arms 20, 20 are returned to a latched position under their own elastic force and a spring force of the guide arm 62. By doing so, the side edges of the printed board 8 are latched by the engaging projection 92 and held in the rotated position. At this time, since the urging forces of the spring contacts 12C, 12D are transmitted by the printed board 8 and engaging projections 92 to the latch arms 20, 20, a twisting force acts upon the latch arms 20, 20 along their axes. Since, however, the auxiliary arms 64 of the latch arms 22 are abutted against the lugs 90, the latch arms 20, 20 hold the printed board 8 in place without being twisted. To this end, the forward end of the auxiliary arms 64 are preferably abutted against the lower side of the lugs 90.

An explanation will be given below about the operation of the latch arms 18 with reference to FIGS. 1, 5A, 5B and 7.

When the printed board 6 is inserted in the insertion slot 32 of the housing 14 and rotated into abutting engagement with the engaging projections 86 of the latch arms 18, the cams 88 on the engaging projections 86 urge the latch arms 18 outwardly. The latch arms 18 starts immediately moving from the latched position as shown in FIG. 1, causing the side edges of the printed board 6 to move laterally while sliding on the cam faces 88.

With the printed board 6 further rotated, the latch arms 18 are moved toward the direction of the support arms 16 while depressing the spring sections 54. By doing so, the latches 18, 18 are opened and the printed board 6 is further rotated clear of the cam faces 88 and the printed board 6 is abutted against the upper surfaces of the latch arms 18, 18 to prevent its excessive movement. As a result, the latch arms 18 are returned back to the latched position under their own elastic force and a spring force of the latch guide 22. By doing so the side edges of the printed board 6 are latched by the engaging projections 86, thus being held in the rotated position.

According to the present invention, since the spring section 54 is provided on the latch guides 22, the latch arms 18 can be returned immediately even if the printed board 8 is abutted against the upper surfaces of the latch arms 18.

In the case where the printed circuits 6 and 8 are to be removed, the latch arms 18, 20 are turned externally by the lugs 80, 90 to the unlatched positions as shown in FIGS. 6 and 7. By doing so, the printed boards 6, 8 are unlatched from the engaging projections 86, 92. The printed boards 6, 8 are turned away from the latch arms 18, 20 by the urging forces of the spring contacts 12.

In moving the latch arms 18 between the latching position and the unlatching position the respective projections 82 are slidably guided on the guide edges provided at the edges of the guide sections 52 to allow the engaging projections 86 to be moved along the flat plane of the printed board 6. By doing so, the engaging projections 86 made of an insulating material allow a smooth engagement with the side edges of the printed board 6. Further, bending- and twisting-direction forces acting from-the printed board 6 through the engaging projections 86 to the latch arms 18 are transmitted to the support arms 16 through the guide sections 52 and fitting sections 50 and also to the mother board 4 through the fixing legs 58 of the latch guides 58. For this reason, the printed board 6 is held very firmly in place while maintaining the easiness with which the latch arms 18 are curved. Further, since the latch guide 22 made of a metal is held between the support arm 16 and the latch arm 18, the safety of the daughter board, is secured due to the metal portion of the latch guide being hardly exposed to an outside.

Figure 8:
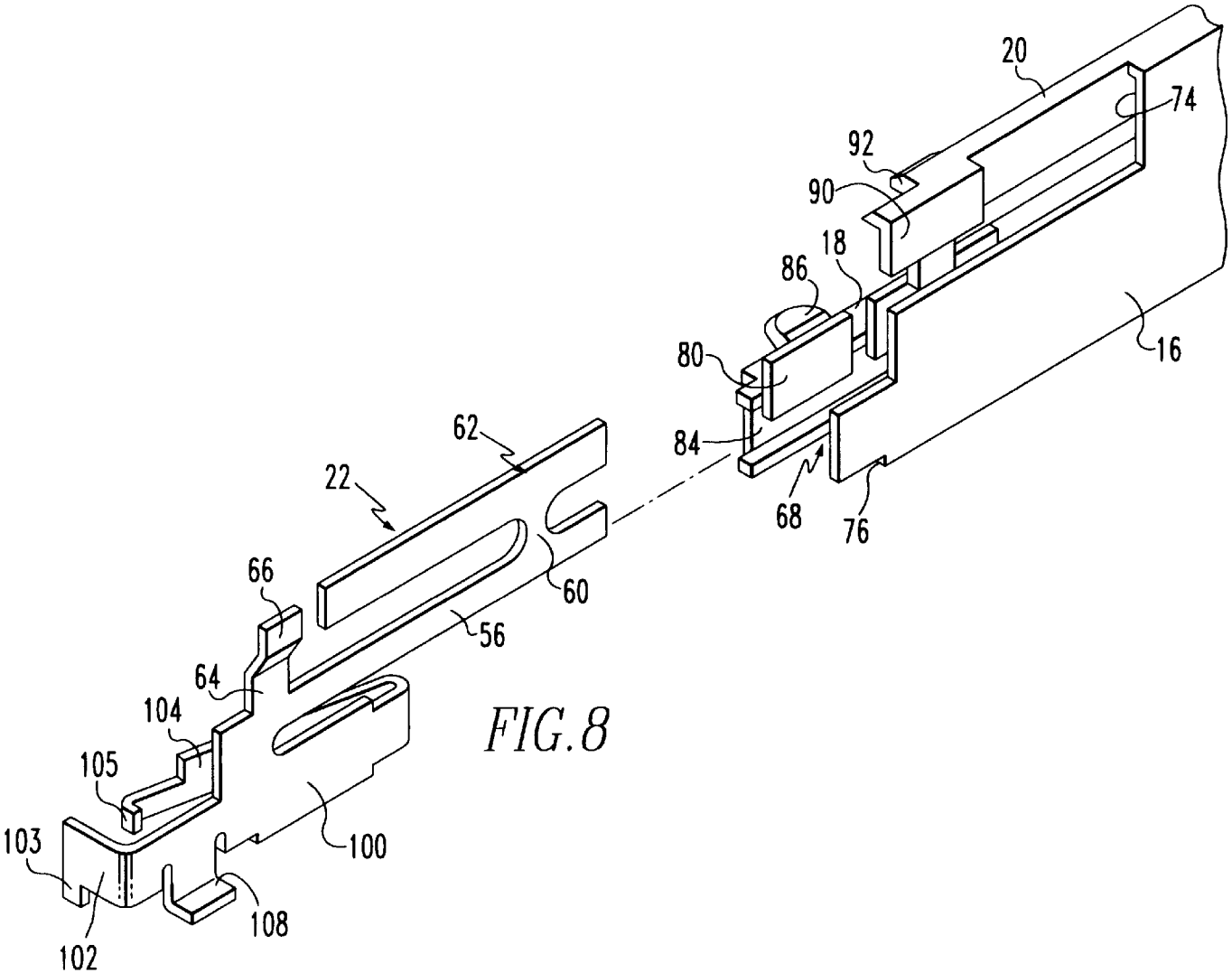
FIG. 8 is a perspective view diagrammatically showing a latch mechanism according to a variant of the present invention.
Figure 9:
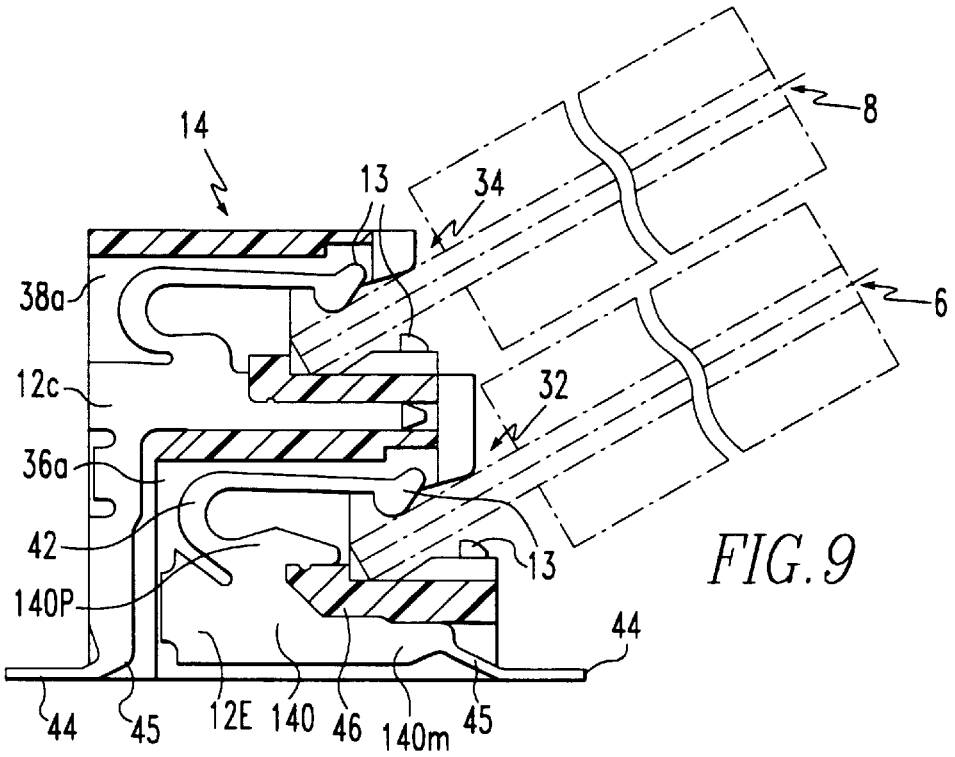
FIG. 9 is a cross-sectional view, similar to that of FIG. 3, showing spring contacts according to a variant of the present invention.
Figure 10:
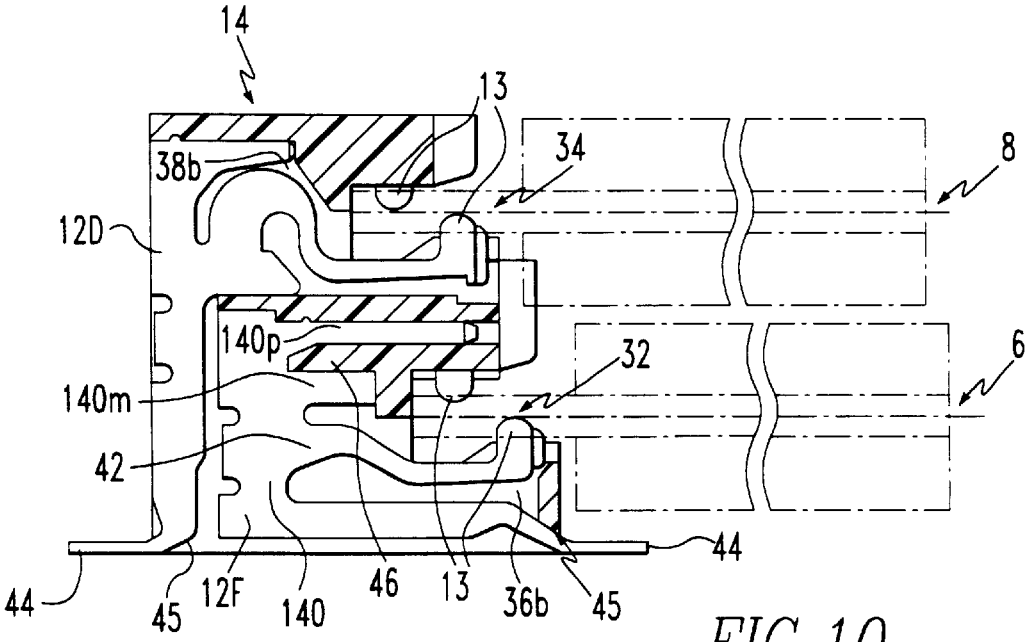
FIG. 10 is a cross-sectional view, similar to that of FIG. 4, showing spring contacts according to a variant of the present invention.

FIGS. 8 to 10 show a variant of a socket 10 for printed boards. In FIGS. 8 to 10, the same reference numerals are employed to designate parts and elements corresponding to those shown in the embodiment above.

The socket of this variant enables the lowering of a height to which it extends from the mother board.

A latch mechanism of the variant is made lower in the height of a fitting section 100, guide section 102 and spring section 104 of a latch guide 22 with only one projection 103 provided on the forward end portion of the guide section 102. Further, a curved portion 105 merging with a spring section 104 of the latch guide is made lower in height than the spring section 104. In addition to a receiving recess 68 of a support arm 16 where the guide section 102 is fitted, a recess 84 of a latch arm 18 is also made lower in the height dimension. For this reason, it is possible to reduce the height of the support arm 16, latch arm 18 and housing 14.

FIGS. 9 and 10 show a variant of spring contacts 12 held in the housing 14 of such a lower height.

Those spring contacts 12C and 12D are the same as those of the above-mentioned embodiment in that those downwardly extending legs are lower than the counterparts of the embodiment. On the other hand, spring contacts 12E and 12F providing a spring contact array at an insertion slot 32 have their fixing sections 140 different from those of the spring contacts 12A and 12B shown in FIGS. 3 and 4.

As shown in FIG. 9, the fixing section 140 of the spring contact 12E firmly grasps a fixing wall 46 between a post section 140*p* and an arm section 140*m* and a flexible area 45 is formed on a leg section extending from the arm section 140*m* and an electroconductive section 44 is formed on the forward end portion of the flexible section 45. As shown in FIG. 10, the fixing section 140 of the spring contact 12F firmly grasps the fixing wall 46 between the arm section 140*m* and post section 140*p* arranged above a spring section 42. The leg section of the spring contact extends from the lower end side of the fixing section 140 toward that forward end side where the insertion hole 32 is opened, the forward end portion of the fixing section having a flexible area 45 and electroconductive section 44. An adequate gap is provided between the leg section and the spring section 42, thus offering no bar to the function of the spring 42.

Contact grooves 36*a* and 36*b* holding the spring contacts 12E and 12F in place are opened on a side opposite to the insertion slot 32 and a connection area for leading the electroconductive area 44 to an outside of the housing 14 is opened on the same side as that of the insertion slot 32. Therefore, the insertion holes of the contact grooves 36*a* and 36*b* are opened on the same side as contact grooves 38*a,* 38*b* holding the spring contacts 12C and 12D in place. The connection areas of the contact grooves 36*a,* 36*b* are opened on the side opposite to the connection areas of the contact grooves 38*a,* 38*b*. The fixing wall 46 is projected from the insertion hole 32-opening side toward the left or rear side in FIG. 10 and into a holding area. When, therefore, the spring contacts 12E and 12F are inserted into the insertion holes provided on the left side, the insertion wall 46 are allowed to be fitted between the post section 140*p* and the arm section 140*m*. By doing so, the fixing wall 46 is firmly grasped between the post section 140*p* and the arm section 140*m* so that the spring contacts 12E and 12F are positively fitted in the contact grooves 36*a,* 36*b*.

In consequence, the socket shown in FIGS. 9 and 10 allows the respective spring arms 12C, 12D, 12E and 12F to be very easily fitted therein without interference with the support arm 16 and latch arms 18, 20 and, at the same time, the socket allows mutually adjacent electroconductive sections of these spring arms to be maintained at requisite intervals.

As set out above, according to the socket of the present invention, a housing of an insulating material has a plurality of insertion holes opened on one side to allow the edges of printed boards to be received therein, a greater number of spring contacts of an electroconductive material are formed in at least one contact array, have their contact sections projected into, and along a longitudinal direction of, the insertion holes and urge the printed boards in the same direction with their edges inserted relative to the respective contact array into the insertion holes, and a plurality of pairs of latch arms extend from near-end areas of the respective insertion holes and, when the respective printed boards are rotated in a direction to urge the contacts, latch the side edges of the printed boards in place whereby the printed boards fitted at the respective insertion holes are held in place by the paired latch arms in a juxtaposed relation. It is, therefore, possible to latch and unlatch the printed boards readily and positively and to manufacture sockets at low costs in a very simple way.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A socket for printed boards, comprising:

a housing made of an insulating material and having a plurality of insertion slots opened on one side in a juxtaposed relation to allow edges of the printed boards to be received therein;

a number of spring contacts made of an electroconductive material, formed in at least one contact array in, and along a longitudinal direction of, the respective insertion slot with contact portions projected in the insertion slot and adapted to urge the respective printed boards in the same direction with the edges of the printed boards inserted into the respective insertion holes relative to the respective contact arrays;

a plurality of pairs of latch arms extending from nearend areas of the respective insertion slots and, when the respective printed boards are rotated in a direction to urge the contacts, latching the side edges of the printed board, whereby the printed boards mounted in the respective insertion holes are held in place by the paired latch arms in a juxtaposed relation;

a pair of support arms extending from ends of the housing and on one side of the housing where the insertion holes are opened; and a pair of latch guides attached to the support arms and, when the latch arms are moved between a position where the latch arms latch the side edges of the printed board and a position where the latch arms unlatch the side edges of the printed board, guiding the latch arms adjacent the support arms, the latch guide being comprised of one member having a fitting section fitted at the support arm and a plurality of guide sections extending from the fitting section and guiding the respective arm.

2. The socket according to claim 1 wherein the spring contact has a fixing section fixed to the housing, a spring section extending from the fixing section and elastically supporting the contact portion of the spring contact, and an electroconductive section extending from the fixing section to an outside of the housing, a flexible area being provided at a leg section between the electroconductive section and the fixing section to absorb a force involved.

3. The socket according to claim 1 wherein the housing has a number of contact grooves for receiving the spring contacts in a mutually insulating state and each respective contact groove has a spring section receiving area elastically deformably holding the spring section of the spring contact and communicating with the insertion slot, a retaining area retaining the fixing section firmly, a connection area leading the electroconductive section to an outside of the housing, and a contact insertion hole opened at one of said one side and other side of the housing.

4. The socket according to claim 1 wherein the housing has two outer walls extending in a longitudinal direction and two insertion slots extending at an intermediate section between the two outer walls and in a substantially parallel relation.

5. The socket according to claim 4 wherein all the contact insertion holes are opened on said other side of the housing.

6. The socket according to claim 4 wherein contact grooves provided at one side of the contact insertion slot to receive those contacts in the contact array have connection areas opened on said one side of the housing and contact grooves provided at the other side of the contact insertion slot to receive those contacts in the associated contact array have connection areas opened on said other side of the housing.

7. The socket according to claim 3 wherein the housing has a fixing wall projected in the contact grooves provided at one side of the contact insertion hole to receive those contacts in the contact array and situated in the retaining area in the contact groove and the fixing section of the spring contact fitted in the contact groove has a post section and an arm section holding the fixing wall relative to the post section and said electroconductive section extends from the arm section.

8. A socket for printed boards, comprising:

a housing made of an insulating material and having a plurality of insertion slots opened on one side in a juxtaposed relation to allow edges of the printed boards to be received therein;

a number of spring contacts made of an electroconductive material, formed in at least one contact array in, and along a longitudinal direction of, the respective insertion slot with contact portions projected in the insertion hole and adapted to urge the respective printed boards in the same direction with the edges of the printed boards inserted into the respective insertion holes relative to the respective contact arrays; whereby contacts may be inserted from opposite sides of the housing.

* * * * *